United States Patent [19]

Horino et al.

[11] Patent Number: 4,458,816

[45] Date of Patent: Jul. 10, 1984

[54] THIN SHEET SORTING APPARATUS

[75] Inventors: Shigeo Horino; Hiroshi Ohba, both of Tokyo, Japan

[73] Assignee: Tokyo Shibaura Denki Kabushiki Kaisha, Kawasaki, Japan

[21] Appl. No.: 305,342

[22] Filed: Sep. 24, 1981

Related U.S. Application Data

[63] Continuation of Ser. No. 86,664, Oct. 19, 1979, abandoned.

[30] Foreign Application Priority Data

Oct. 30, 1978 [JP] Japan ..... 53-132539
Oct. 30, 1978 [JP] Japan ..... 53-132540

[51] Int. Cl.[3] ..... B07C 5/344

[52] U.S. Cl. ..... 209/548; 209/534; 209/551

[58] Field of Search ..... 209/534, 546, 548, 549, 209/551; 194/4 R

[56] References Cited

U.S. PATENT DOCUMENTS

| | | | |
|---|---|---|---|
| 3,710,936 | 1/1973 | Mizunuma | 209/551 X |
| 3,756,256 | 9/1973 | Hatanaka et al. | 194/DIG. 26 |
| 3,759,382 | 9/1973 | Walkley et al. | 209/534 |
| 3,930,581 | 1/1976 | Gray | 209/551 X |
| 3,976,198 | 8/1976 | Carnes, Jr. et al. | 209/534 |
| 4,025,420 | 5/1977 | Horino | 209/534 |
| 4,166,030 | 8/1979 | Lewis et al. | 209/534 |
| 4,334,619 | 6/1982 | Horino et al. | 209/551 |

FOREIGN PATENT DOCUMENTS

| | | |
|---|---|---|
| 2700901 | 5/1977 | Fed. Rep. of Germany . |
| 1488133 | 10/1977 | United Kingdom . |
| 1555432 | 11/1979 | United Kingdom . |

*Primary Examiner*—Robert B. Reeves
*Assistant Examiner*—Edward M. Wacyra
*Attorney, Agent, or Firm*—Cushman, Darby & Cushman

[57] ABSTRACT

The thin sheet sorting apparatus includes a supply device for supplying, one after one, the thin sheets to be sorted. A detecting device classifies the thin sheets into one of normal sheets, improper sheets and damaged sheets. A sorting device directs the improper sheets to a first conveying passageway, and the damaged sheets and the normal sheets to a second conveying passageway, respectively. A counting circuit counts the number of thin sheets guided to the first and second conveying passageways. The supply device supplies the thin sheets in discrete units each containing a predetermined number and the counting circuit counts the number of the sheets sorted for each predetermined number, thus confirming the predetermined number.

8 Claims, 14 Drawing Figures

FIG. 3

| | BATCH NUMBER | OPERATION RESULT (Q, Qn, Qn+1) |
|---|---|---|
| 1 | | |
| 2 | | |
| | | |
| n − 1 | | |
| n | | |
| n + 1 | BATCH NUMBER | |
| n + 2 | THE NUMBER OF THE REJECTIVE NOTES | |
| n + 3 | THE REAPPLIED NUMBER OF THE REJECTIVE NOTES | |
| n + 4 | THE TOTAL SUM OF THE REJECTIVE NOTES | |
| n + 5 | THE NUMBER OF THE UNFIT NOTES | |
| n + 6 | THE REAPPLIED NUMBER OF THE UNFIT NOTES | |
| n + 7 | THE TOTAL SUM OF THE UNFIT NOTES | |

THIN SHEET SORTING APPARATUS

This is a continuation of application Ser. No. 86,664 filed Oct. 19, 1979, now abandoned upon filing this application.

This invention relates to a thin sheet sorting apparatus for classifying thin sheets as bonds, bank notes, paper money, etc. according to condition and denominations or the like. Paper money or bank notes, recovered by banks, are generally manually classified according to denomination, and money of the same denomination is classified according to whether each bill is improper, such as counterfeit or otherwise not effective or fit. The fit bills are further classified into normal ones (can be used again) and damaged ones (effective, but unsuitable for use again). 100 normal paper bills of the same denomination are wrapped with a narrow paper band or strap and sealed to form a batch. 10 such batches (a total of 1000 paper bills) are wrapped with a wide paper band to form a bundle. To further ensure the accuracy of classification each bundle of 1000 normal paper bills are again fed through a sheet sorting apparatus. Such apparatus automatically counts the number of bills supplied to it to check whether the number of the bills is correct or not, to detect any improper bills, bills of different types, and to classify the fit bills into normal and damaged ones. 100 bills of each type are bundled into a batch and sealed. When an unfit bill is detected by the apparatus, the sorting apparatus is locked immediately. Although it is customary that a single bank make its 1000 bill bundles (without contribution from other banks), batches, each containing 100 bills, are often processed by different operators. Accordingly, should an improper bill be detected, it is desirable to know which operator processed a batch containing the improper bill.

However, prior art sorting devices process sheets in discrete units each containing 1000 sheets, as above described. For this reason, prior art device can judge whether a bundle actually contains 1000 sheets, and judge whether the bundle contains any improper notes, but the prior art devices cannot judge which one of the 10 batches contains the improper sheet or sheets.

To determine which batch contains the improper sheets, it is necessary to check each batch instead of a bundle. To this end, if each batch is processed separately, the inoperative time of the apparatus increases, thus greatly decreasing the processing capability of the apparatus. Also, the load of the operator increases because the operator is required to frequently supply batches of 100 sheets each to the apparatus, thus failing to accomplish the object of the apparatus of saving man power.

In other known sorting devices which process sheets in discrete units of 100 sheets each, it is necessary to insert sorting cards for each unit of 100 sheets. This also increases the burden of the operator so that it is not suitable for practical use.

Accordingly, it is an object of this invention to provide an improved thin sheet sorting apparatus which can process continuously thin sheets in discrete units each containing a predetermined number of sheets (for example 100 sheets), can decrease wasted time during which the operation of the apparatus must be stopped between respective units and can eliminate the operators burden necessary to insert the sorting cards thus increasing the efficiency of the apparatus.

According to this invention these and further objects can be accomplished by providing thin sheet sorting apparatus comprising supply means in which thin sheets to be sorted are set in discrete units each including a predetermined number of the thin sheets, pickout means for successively picking out, one after one, the thin sheets set in the supply means, sorting means for sorting the picked out thin sheets into fit thin sheets and a balance and for guiding the fit thin sheets and the balance along first and second conveying passageways respectively, and counting means for arithmetically controlling the number of the thin sheets guided to the first and second conveying passageways and a predetermined number of the thin sheets, presumable that they have been set in the supply means thereby judging excess or shortage of the predetermined number.

In the accompanying drawings:

FIGS. 1A and, 1B are diagrammatic representations showing one embodiment of the thin sheet sorting apparatus embodying the invention;

FIG. 3 is a diagram showing the arrangement of memory addresses of a memory device;

In the following description the term "thin sheet" is used to mean a bank note but it should be understood that the invention is not limited to the processing of bank notes.

Figure 1A:
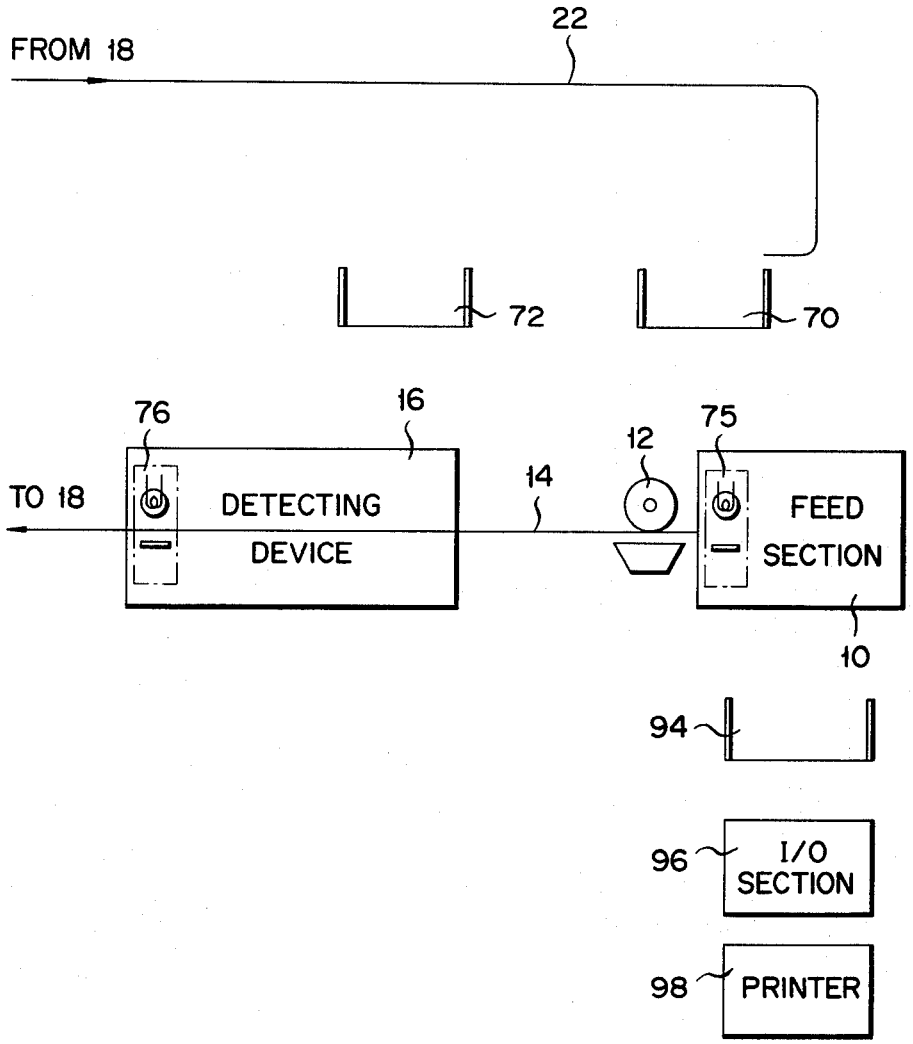
Figure 1B:
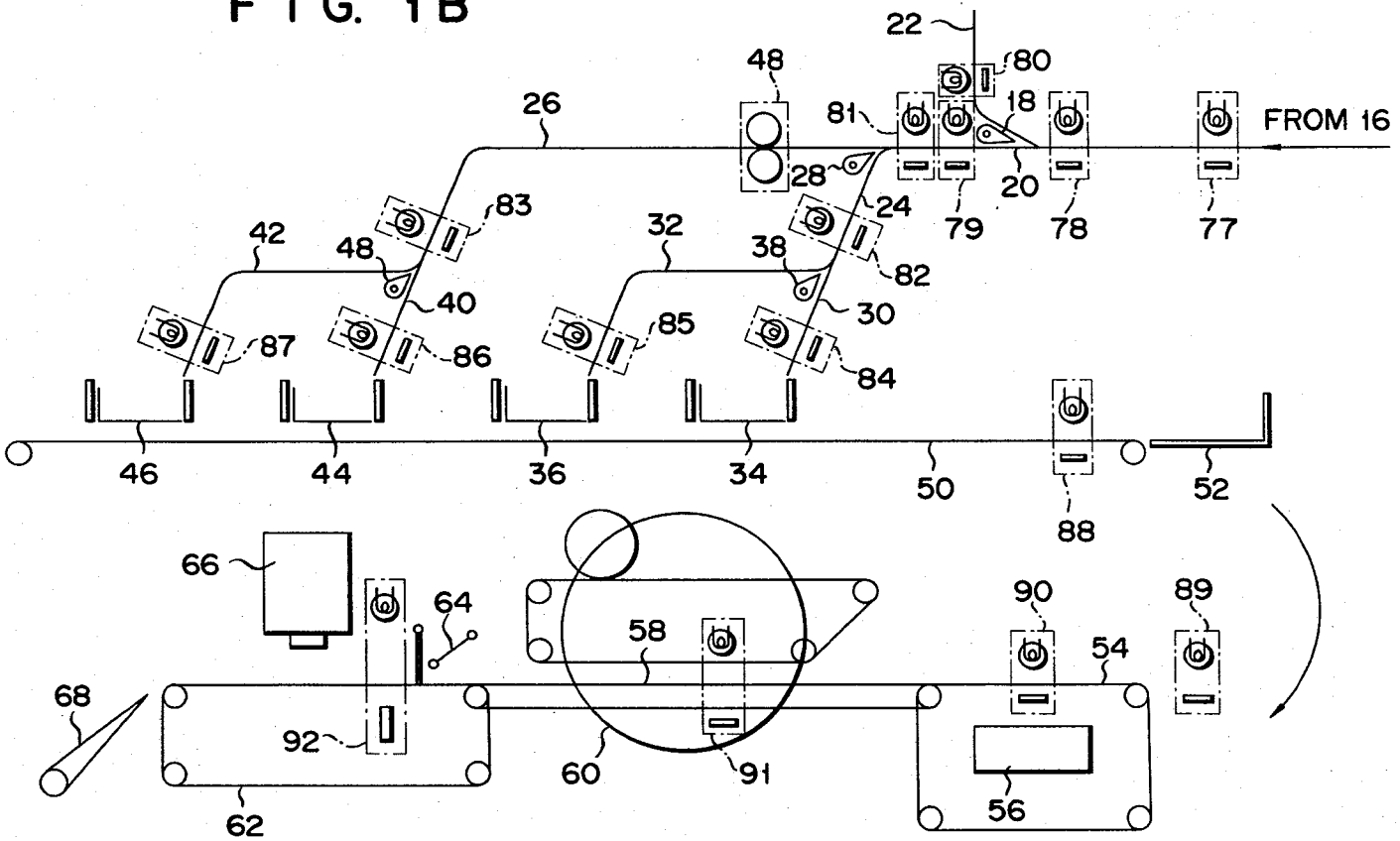

As diagrammatically shown in FIGS. 1A and 1B a preferred embodiment of this invention comprises a feed section 10 which supports one bundle (that is 1000 sheets) of bank notes (for brevity called "note") in an upright position. As the apparatus starts, the feed section 10 supplies the notes in successive batches (each containing 100 notes) to a pickout device 12. The notes in one batch are successively taken out with a predetermined spacing and supplied to a conveying device 14, for example a belt conveyor. The pickout device 12 is constituted by a vacuum suction rotor, for example. In the conveying device 14, the notes taken out by the pickout device are clamped between a pair of conveyor belts and sent to a detecting device 16 and a sorting device 18 to be described later. The detecting device 16 installed at an intermediate point of the conveying device 14 has a construction disclosed in U.S. Pat. No. 4,025,420 and operates as follows:

More particularly, its first function is to accurately count the number of notes being conveyed for checking for the passage of a batch of notes. For example, when two or more notes are simultaneously taken out by the pick out device 12, that is in a superposed state, it becomes impossible to make an accurate detection and counting of the number of notes. The detecting device 16 operates to detect such superposition. Either an optical method in which the quantity of light transmitting through the notes is detected, or a mechanical method, in which the thickness of the notes is measured by mechanical means, may be employed by detecting device 16 to detect superposition. Secondly, when two or more notes taken out by the pickout device 12 are too close each other, or the ends of the notes contact with each other it is also impossible to accurately detect and count the number thereof. The second function of the detecting device 16 is to detect such abnormal proximity. Such detection can be accomplished by detecting the spacing between adjacent notes and then comparing it with a normal or reference spacing. The third function of the detecting device 16 is to check the impression of respective notes being conveyed by the conveying device to classify them into a group of fit notes and a group of improper notes (notes of different denominations, counterfeits, not effective notes and other doubtful notes) and further to classify the fit notes into damaged notes, that is notes unsuitable for recirculation, and normal notes, that is those qualified for recirculation. If necessary, an optical character reader may be incorporated into the detecting device 12 to read predetermined informations (for example the number of the note) for separating notes issued in earlier days. To this end, the detecting device 16 is constituted by using one or a plurality of pairs of detectors for different purposes. Thus, each detector judges whether each note is normal, or damaged or improper (unfit and superposed notes). Based on these results a final judgement is given to each note according to the order of priority shown in the following Table.

TABLE

| Order | Final decision | Reason |
|---|---|---|
| 1st | improper | Any one of the members of the detecting device decides the note to be rejected |
| 2nd | damaged | Though one or more members of the detecting device decides the note to be normal, at least one member thereof judges the note to be undesirably damaged |
| 3rd | normal | None of the members of the detecting device decides the note to be improper or damaged, but all the members thereof judge the note to be normal. |

There is provided a sorting device 18 near the end of the conveying device 14 for sending notes conveyed by the conveying device 14 through the detecting device 16 to a first conveying passageway 20 or a second conveying passageway 22 in accordance with the signal showing the result of judgement of the detecting device 16, said signal being shifted by a note locating circuit to be described hereinbelow. More particularly, notes judged improper by the detecting device 16 are guided to the second conveying passageway 22 whereas those judged as damaged or normal are guided to the first conveying passageway 20. The first conveying passageway 20 is divided into one conveying passageway 24 that conveys the normal notes to a collector to be described later, and another conveying passageway 26 that conveys damaged notes to another collector to be described later. At the branching point is provided a sorting device 28, which is controlled by a signal from the note locating circuit to be described later in the same manner as above described sorting device 18. The normal note conveying passageway 24 is divided into one conveying passageway 30 that conveys the normal notes to another first normal note collector 34 and a conveying passageway 32 that conveys the normal notes to a second normal note collector 36. A sorting device 38 is provided at the branching point which is controlled by a signal from a counter to be described hereinafter. The damaged note conveying passageway 26 is divided into one conveying passageway 40 that conveys damaged notes to a first damaged note collector 44 and another conveying passageway 42 that conveys damaged notes to a second damaged note collector 46. A sorting device 48 is provided at the branching point which is also controlled by a signal from a counter to be described later. Collectors 34, 36, 44 and 46 operate to successively stack notes conveyed thereto and are provided with a vertically movable bottom plate controlled by a signal from a counter to be described later. At an intermediate point of the damaged note conveying passageway 26 is provided a cancellation stamp device 48 which applies cancellation stamps onto the notes being conveyed by the conveying device representing that they are damaged notes, there by precluding them from being recirculated. Alternatively, a perforator may be provided for perforating damaged notes. However, the cancellation device and the perforator are not always necessary.

A note batch conveying device 50 is provided to extend beneath collectors 34, 36, 44 and 46 to be used commonly, for conveying batches of 100 notes, for example, to a course changing device 52 which rotates 90° the note batches supplied thereto and sends the rotated batches to a note batch conveying passageway 54. The note batch conveying passageway 54 sends the note batches sent from the course changing device 52 to a note batch aligning device 56, which operates to neatly pile up the note batches. The note batch conveying passageway 54 next sends note batches rearranged by the note batch aligning device 56 to note batch conveying passageway 58 which in turn sends the rearranged note batches to a strapping device 60. The strapping device 60 clamps the received note batches with a strap for preventing them from collapsing. The note batch conveying passageway 58 sends note batches strapped by the strapping device 60 to a next note batch conveying passageway 62 which in turn transfers note batches sent to it to a strap checking device 64 and a printing device 66. The purpose of the strap checking device 64 is to check whether the note batches have been positively strapped or not. The printing device 66 operates to print on the surface of the straps wrapped about respective note batches such important items as a date, an operators code, a device number, and identification marks showing that the notes are normal or damaged. A note batch sorting device 68 is provided at the end of the note batch conveying passage 62. The note batch sorting device 68 selects a note batch selector, not shown, depending upon whether the batch is a normal or a damaged note batch. Above described course changing device 52, rearranging device 56, strapping device 60, pinting device 66 and batch sorting device 68 are all controlled by signals sent from a note batch locating circuit to be described later.

As shown in FIG. 1A, at the end of the second conveying passageway 22 is provided an improper note collector 70 near the feed section 10. The improper note collector 70 operates to successively pile up in a collection box improper notes (unfit and superposed notes) sent to it through the second conveying passageway 22. Upon completion of the sorting of a predetermined number (100) of the notes, the improper note collector 70 moves another collecting box for accumulating the improper notes which are sorted next time whereby each time a predetermined number of improper notes are sorted and they are transferred to the operator. A removable return note box 72 is installed near the collector 70 which is used to receive notes returned from the collectors 34, 36, 44 and 46 respectively under abnormal conditions. The feed section 10 is equipped with a note detector 75 for detecting that all of the notes of a predetermined number (100) set in the feed section 10 have been taken out so that no note is remaining. This detection of the empty condition is used as a reference of checking the counting of a predetermined number of notes as will be described later. Detectors 76~87 are positioned at respective predetermined positions for detecting notes being conveyed. Also a plurality of note batch detectors 88~92 are positioned at respective predetermined positions for detecting note batches being conveyed. These detectors 75~92 may be an optical type including opposing light source and a light receiving element.

Near the feed section 10 are also provided a strap collector 94, an I/O section 96 and a printer 98. The strap collector 94 receives straps which are removed from note batches each containing a predetermined number of notes when the notes are set in the feed section 10. The I/O section 96 comprises a keyboard 162 (to be described later) which is used to key in the number of the rejected notes collected in the improper note collector 70 and counted by the operator, a display device 172 (to be described later) which displays the input data, a display device 166 (to be described later) showing the number of an unfit note batch now being processed by the operator, a receipt output of the printer 98, and a note take out port of the improper note collector. Where the number of the notes of one bundle is larger or smaller than the predetermined number, the printer 98 prints on a receipt the number of that bundle and the number of excess or shortage.

The counters utilized in this apparatus will now be described with reference to block diagrams shown in FIGS. 2A through 2D. These counters are constructed such that they count the number of notes collected in normal note collectors 34 and 36, and damaged note collectors 44 and 46. These counters then temporarily store the counted number and compare the sum of the counted number and the number of improper notes counted by the operator and supplied through the I/O section, with a predetermined specific number H, for example, 100, thereby detecting an excess or shortage of the number of notes supplied. More particularly, when the number of the notes fed coincides with the set value H, the sum of the notes respectively collected in the improper note collector 70, the normal note collectors 34 and 36, and the damaged note collectors 44 and 46 should be equal to H.

The output of the detector 81 provided for the first conveying passageway 20 for the normal and damaged notes is applied to a detection circuit 100, and the output thereof is supplied to counters 106 and 108 respectively through AND gate circuits 102 and 104. The output of the detector 82 installed along the normal note conveying passageway 24 is applied to a detection circuit 110 and the output thereof is supplied to counters 116 and 118 respectively through AND gate circuits 112 and 114. Further, the output of the detector 83 provided for the damaged note conveying passageway 26 is applied to a detection circuit 120 and the output thereof is supplied to counters 126 and 128 respectively through AND gate circuits 122 and 124. On the other hand, the output of the detector 75 installed at the feed section 10 is applied to a timing signal generator 132 via a detection circuit 130. A predetermined timing signal produced thereby is applied to count control circuits 134, 136 and 138 which control AND gate circuits 102, 104, 112, 114, 122 and 124 respectively so as to control counters 106, 116 and 126, and counters 108, 118 and 128 to operate them alternately. A predetermined interval after the detector 75 has detected that all of the notes of the predetermined number H have been taken out from the feed section 10 (feed section 10 is empty), the counts of the counter 116 (118) and counter 126(128) are supplied to an adder 142 via a gate circuit 140 and are added together. The result of the addition operation is sent to one input of a comparator 144. The count of the counter 106(108) is applied to the other input of the comparator 144 via a gate circuit 146 to be compared with the output of the adder 142. The gate circuits 140 and 146 are controlled by a collation control circuit 148 actuated by the output of the timing signal generator 132. If the result of collation shows noncoincidence, the apparatus is in an abnormal condition, due to counting error of the counters, for example, and such noncoincidence is displayed on a noncoincidence display device 150. On the other hand, when the result of collation shows coincidence, an arithmetic operation circuit 152 determines the difference between the count of the counter 106 (108) showing the number of normal and damaged notes, and the content (set value H) of a H signal generator 154, and the result is stored in a memory device 156. The result of the arithmetic operation would coincide with the number of the improper notes if the number of the notes supplied were equal to the set value. The timing signal generated by the timing signal generator 132 is applied to a counter 160 via a count control circuit 158, whereby the counter 160 counts the number of a note bundle which has been sorted, and the count of the counter is stored in the memory device 156 together with the result of the arithmetic operation circuit 152, where the difference between the count of the counter 106(108) and the set value H is calculated and the difference is stored in the memory device 156 after elapse of a predetermined time determined by the timing signal generator 132 succeeding to an instant at which the detector 75 at the feed section 10 detects the fact that a predetermined number of notes have been taken out from the feed section 10. Since two sets of counters 106, 116 and 126; and 108, 118 and 128 are used, the collation can be made automatically without stopping the conveyance of the notes.

The detail of the memory device 156 will now be described with reference to FIG. 3. Thus, the memory device 156 has a plurality of memory addresses, for example from first to nth, and from (n+1)th to (n+7)th addresses. The first to nth addresses are used to store the content of the counter (batch number) 160 which represents the batch number that has been sorted, the difference between the set value H and the count of the counter 106(108) which corresponds to the sum of the notes respectively collected in the normal note collectors 34 and 36 and the damaged note collectors 44 and 46, that is the result of the operation of the arithmetic operation circuit 152. When the sorting of the first batch is completed, the number '1' of the first batch and the result of operation $Q_1$ of the arithmetic operation circuit 152 are stored in the first address, and when the sorting of the second batch is completed a number "2" and the result of calculation $Q_2$ are stored in the second address. In this manner, when storing up to the nth address is completed, the operation returns again to the first address so that the previous content of the first address is cleared and a data "n+1" and the result of calculation $Q_{n+1}$ are stored in the first address. Since the processing speed of the apparatus is determined such that the operation of the comparator 166 which compares the content of the first address (result of operation), that is the number of the rejection notes, with the number of the improper notes counted by the operator and applied by the keyboard 162 completes before the completion of the sorting of the (n+1)th batch completes and the storing in the (n+1)th address becomes necessary, the content of the first address has become unnecessary. In the same manner, the results of operations of the (n+2)th and the following batches are stored in the second and the following addresses, but since the memory capacities of n addresses are sufficiently large enough to accommodate the difference in times for the sorting of the normal and damaged notes, and for collating the number of improper notes inputted by the keyboard 162 and the result of operation of the arithmetic operation circuit 152, the apparatus is constructed such that it is not necessary to stop the sorting operation. In the (n+1)th address of the memory device is stored the batch number applied by the keyboard 162 and representing the number of the improper notes in that batch, and the content of the (n+1)th address is displayed by display device 166. For example, when the number of the improper notes in the first batch is applied through the keyboard 162, a value "1" is stored in the (n+1)th address. Thereafter, each time the number of the improper notes of the succeeding batches are applied, the content of the (n+1)th, address would be increased by +1. In the (n+2)th, (n+3)th and (n+4)th addresses are respectively stored the number of the improper notes supplied by the keyboard 162, the number of the improper note reapplied at the time of misinput, and the total sum of the improper notes up to the preceding batch. In the same manner, the (n+5)th (n+6)th and (n+7)th addresses respectively stored the number of the unfit notes (the difference between the improper notes and the superposed notes), the reapplied number of the unfit notes, and the total sum of the unfit notes up to the preceding batch. In the absence of any input error, the contents of the (n+2)th and the (n+5)th addresses would be stored in the (n+3)th and (n+6)th addresses respectively.

As above described the number of the improper notes applied through the keyboard 162 is applied to a comparator 168 via an input control circuit 164 and also to the memory device 156 to be stored therein. At first, collation of the counts is made to specify a specific batch and its number is stored in the (n+1) address of the memory device 156 by the keyboard 162. Then, the memory device 156 selects the number same as the content of the (n+1)th address among first to nth addresses for reading out the result of operation which has been stored corresponding to the selected number, thus supplying read out result to the comparator 168 which compares this result with the number of the improper notes calculated by the operator and applied through the keyboard 162 thereby effecting collation of the counts. The difference between the number of the improper notes and the number of the superposed notes, that is the number of the unit notes is also stored in the (n+5)th address of the memory device 156 by the keyboard 162. If a coincidence is obtained, in other words, if it is judged that the number of the notes fed is equal to the predetermined value, the next batch number and the numbers of the improper notes and the unfit notes of the next batch would be applied by the ten key 162. In this way the collation of the next batch would be processed. At this time, the memory device increases the content of the (n+1)th address by +1 and clears the contents of the (n+2)th and (n+5)th addresses to store therein the numbers of the improper notes and of the unfit notes just in the same manner as above described. Furthermore, the memory device 156 operates to add the contents of the (n+3)th and (n+6)th addresses respectively to the contents of the (n+4)th and (n+7)th addresses and to store again the results of additions in the (n+4)th and (n+7)th addresses.

Where the result of collation by the comparator is noncoincidence, that is the number of the notes supplied to the feed section 10 is larger or smaller than the predetermined number, this fact is displayed by a display device, not shown, while at the same time, an input lock circuit 170 operates to electrically lock the keyboard 162. The value applied by the keyboard 162 (the number of the improper notes) is displayed by a display device 172 so that the operator visually confirms again the applied value and the number of notes in the improper note collector, and where there was an input error be applied against the correct number of the notes. The value reapplied in this manner is applied to the comparator 168 and again compared with the result of operation. If a coincidence were obtained, the printer 98 would operate to respectively print the content of the (n+1)th address of the memory device 156, that is the batch number sorted, the content of the (n+2)th address, that is the number of the improper notes applied through the keyboard 162, and the content of the (n+3)th address, that is the reapplied number of the improper notes thereby discharging a printed receipt.

If there is no input error of the number, and where coincidence is not obtained even when the data was applied again, in other words, the number of the notes supplied to the feed section 10 was not correct, a supervisor unlocks the input lock circuit 170 which has been locked previously to operate the printer 98 to print the contents of the (n+1)th, (n+3)th and (n+6)th addresses of the memory device 156 and the content of the comparator 168. On the assumption that there are improper notes, when the keyboard 162 applies data other than "0" the input lock circuit 170 is also locked. When the supervisor unlocks the input lock circuit 170, the contents of the (n+1)th, (n+3)th and (n+6)th addresses in the memory device 156 would be printed in the same manner as in the case of non-coincidence described above.

When all sorting operations are completed and when the collation of the counts of the input from the keyboard 162 and the result of operation is also completed, the printer 98 is operated by a finish button, not shown, to print the data in the (n+1)th address of the memory device 156 (the number of the sorted batch), the data in the (n+4)th address (sum of the numbers of the unfit notes and the superposed notes) and the data in the (n+7)th address (total sum of the unfit notes). By observing this printing, the operator can confirm again the number of the unfit notes and that of the superposed notes.

A method of confirming the number of notes that have been sorted and collected in respective collectors will be described as follows. The count output of a normal note counter 176-1 (see FIG. 2C) driven by a signal from the detector 82 in the normal note conveying passageway 24 is supplied to one input of a comparator 178-1, the other input thereof being supplied with a signal sent from a signal set circuit 180-1 and representing a set number D(in this example 100). Accordingly, when the number of the normal notes collected in one normal note collector reaches the set number, the comparator 178-1 produces a coincidence signal so as to drive the sorting device 38 via a sorting control circuit 182-1 and a drive circuit 184-1. Thus, the notes being conveyed are sorted and accumulated in the other normal note collector. For example, assume now that 100 normal notes have been firstly collected in the first normal note collector 34 and then the sorting device 38 is switched so as to collect the normal notes in the second normal note collector 36. Then, the count of the counter 188-1 selected by the sorting control circuit 182-1 via a gate circuit 194-1 from a set of counter 188-1 connected to the detector 84 of the first normal note collector 34 via a detection circuit 186-1 and a counter 192-1 connected to the detector 85 of the second normal note detector 36 via a detection circuit 190-1, and the set number of the notes D are compared by a counter 196-1. When a coincidence is obtained, the drive circuit 200-1 is actuated by an collector control circuit 198-1 to drive the bottom plate of the first normal note collector 34 for taking out a batch of 100 notes. The operation of the comparator 196-1 and the collector control circuit 198-1 is controlled by a predetermined timing signal produced by the timing signal generator 202-1 operated by the output of the comparator 178-1. When a batch of 100 notes is taken out and the operation of the first normal note collector 34 completes, the count of the normal note counter 204-1 is increased by +100. After the fact that 100 normal notes have been transferred has been detected by the comparator 178-1, a comparator 196-1 detects again whether the number of the collected normal notes is 100 or not so that the result of the comparator 196-1 would be a coincidence. However, if both data do not coincide with each other, an erroneous sorting display device 206-1 would be operated to display that the apparatus is in an abnormal condition.

The sorting control circuit 182-1 is connected to control a collector select circuit 208-1 so as to select device circuits 200-1 and 210-1. Furthermore, the collector select circuit 208-1 selects the count of either one of the counters 188-1 and 192-1 through a gate circuit 210-1 to apply the content of the selected counter to a comparator 212-1 which compares the count of the counter 176-1 (the number of normal notes conveyed through the normal note conveying passageway) with the count of counter 188-1 or 192-1 (the number of the normal notes collected in the normal note collector). Where the counts do not coincide with each other, a noncoincidence display device 214-1 is operated, thereby locking the apparatus. The count of the selected counter 188-1 or 192-1 is stored in a memory device 216-1. In the same manner, the number of the damaged notes collected in the damaged note collector is processed by a circuit shown in FIG. 2D in which elements corresponding to those shown in FIG. 2C are designated by the same reference characters. More particularly, the number of signals from the note detector 83 in the damaged note conveying passageway 26 is counted by a counter 176-2 so as to effect switching between the first damaged note collector 44 and the second damaged note collector 46 caused by the sorting device 48. The detectors 86 and 87 of the damaged note collectors are connected to detection circuit 186-2 and 190-2 respectively. The outputs of these circuits are counted by counters 188-2 and 192-2 respectively to control the drive of the first and second damaged note collectors 44 and 46 respectively.

As above described, with the apparatus of this invention, it is possible to judge whether the number of the notes actually supplied to the feed section 10 is larger or smaller than a prescribed number of subtracting the number of the normal and damaged notes from the number of the notes to be supplied to the apparatus by the operation of the arithmetic operation circuit 152 so as to presume the number of improper notes and then comparing the number of improper notes actually counted by the operator with the presumed number.

Figure 2A:
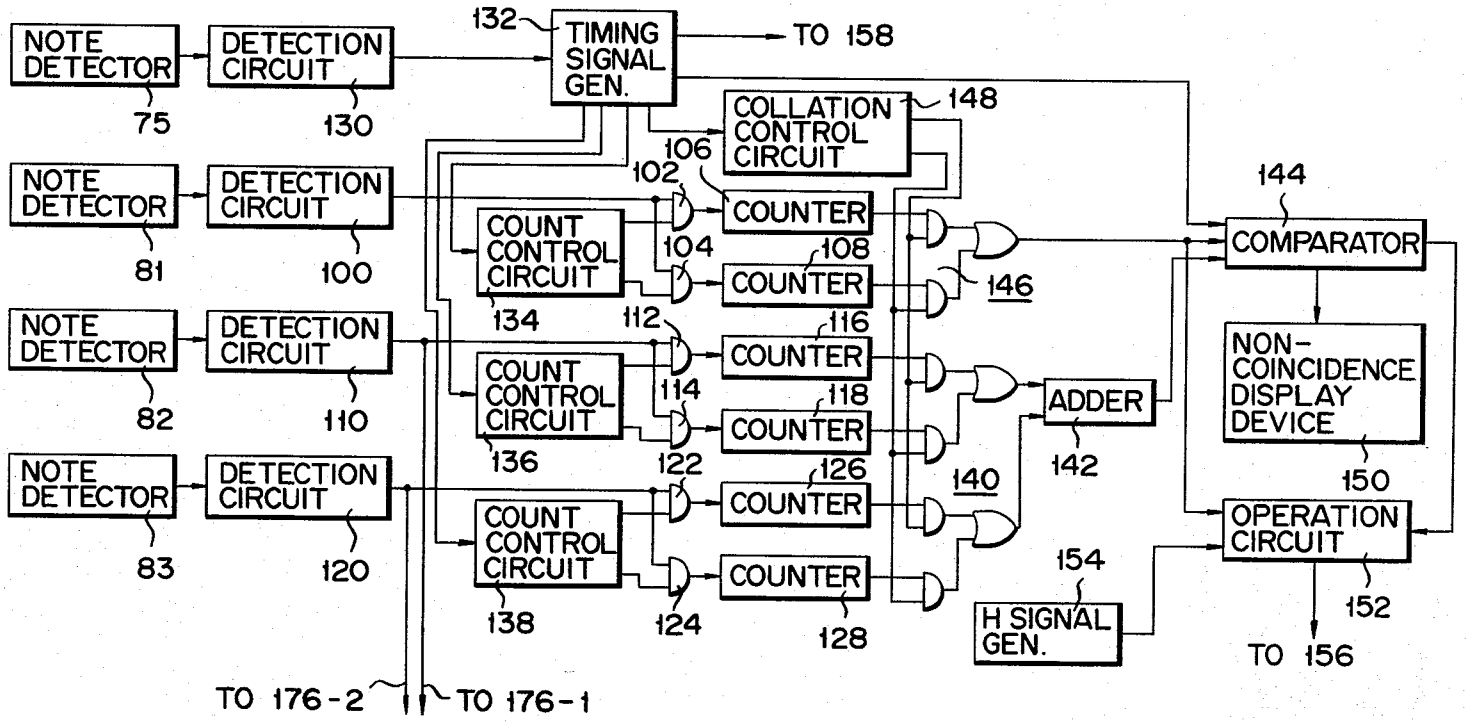
FIGS. 2A through 2D are block diagrams showing the construction of counters.
Figure 2B:
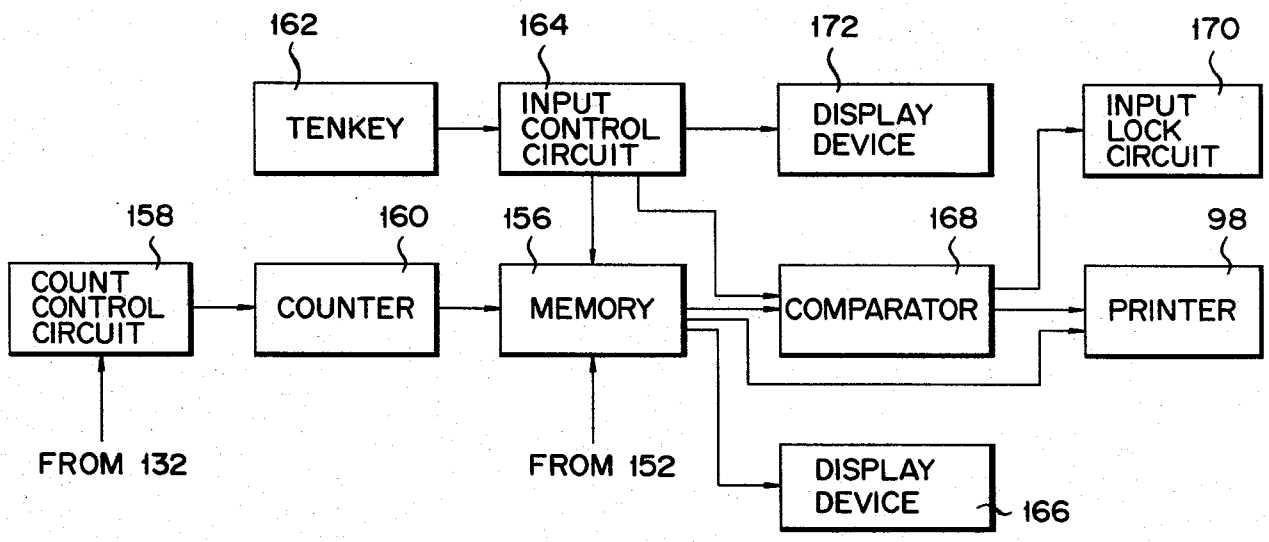
Figure 2C:
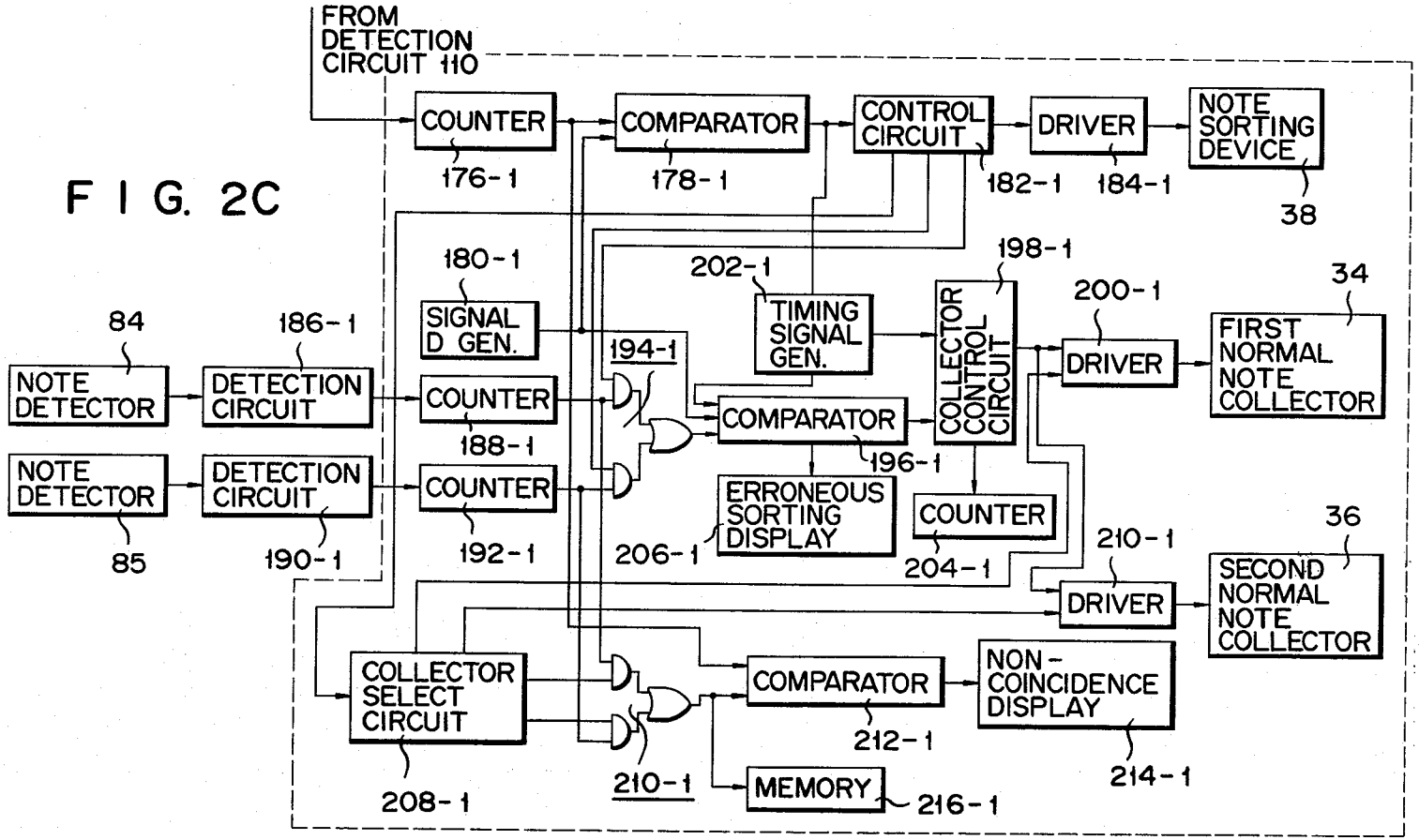
Figure 2D:
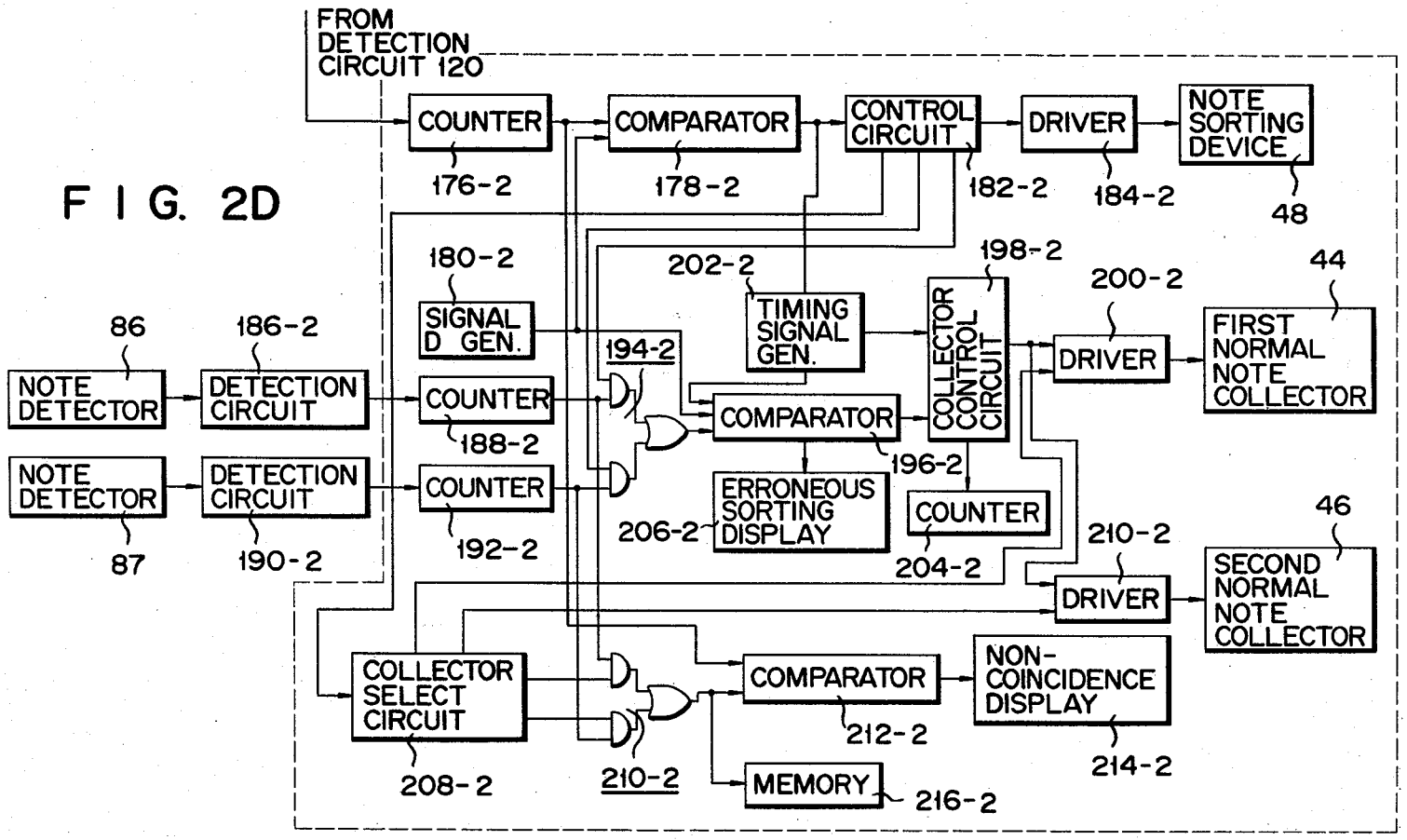
Figure 4:
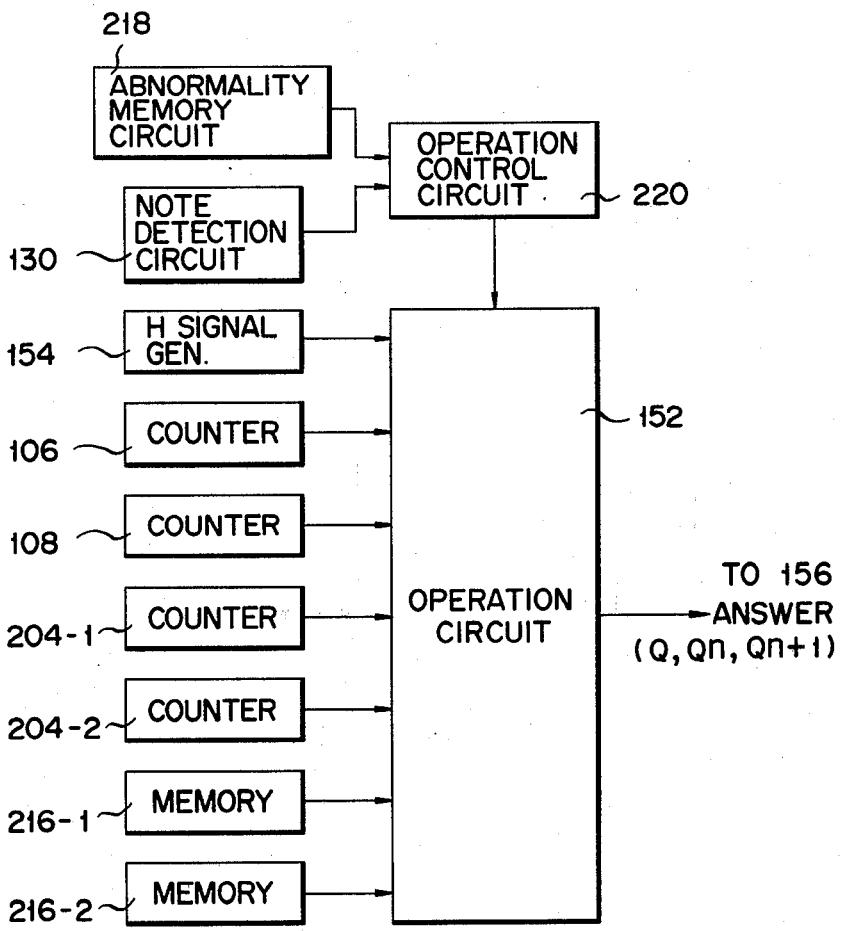
FIG. 4 is a block diagram showing an arithmetic operation circuit.

In respective of such abnormal conditions as jamming, location error or not collation of the counts, etc, the arithmetic operation circuit 152 shown in FIG. 2A can operate the number of improper notes assumed to be collected by the improper note collector 70 without removing all notes from the normal and damaged note collectors and then supply them again. More particularly, as shown in FIG. 4, the arithmetic operation circuit 152 shown in FIG. 2A is supplied with signals from another counters. Component elements shown in FIG. 4 and corresponding to those shown in FIGS. 2A through 2D are designated by the same reference characters for the sake of simplicity. When an abnormal condition occurs, an abnormal condition memory circuit 218 that memorizes this condition, and the note detection circuit 130 at the feed section 10 supply a control signal to an arithmetic operation control circuit 220 for controlling the arithmetic operation circuit 152. More particularly, the number of notes Q which should be entered into the improper note collector 70 under normal state is given by the following equation $$Q=H-G_1(G_2)$$

where

H: the number of the notes which should have been fed $G_1(G_2)$: count of counter 106(108)

In a case where an abnormal condition occurs so that a certain number of the notes are returned to the return note box 72, the result of arithmetic operation Q' would be obtained by calculating the number of notes including such returned number. Abnormal conditions may be classified as follows.

(1) A case wherein an abnormal condition occurs while a single batch alone is being conveyed.

In this case, $$Q'=H-G+RA+RU-PA-PU$$

where

G: $G_1+G_2$

RA: the content of memory device 216-1

RU: the content of memory device 216-2

PA: the count of counter 204-1

PU: the count of counter 204-2

(2) A case wherein an abnormal condition occurs while the nth and (n+1)th batches are being conveyed.

Figure 5:
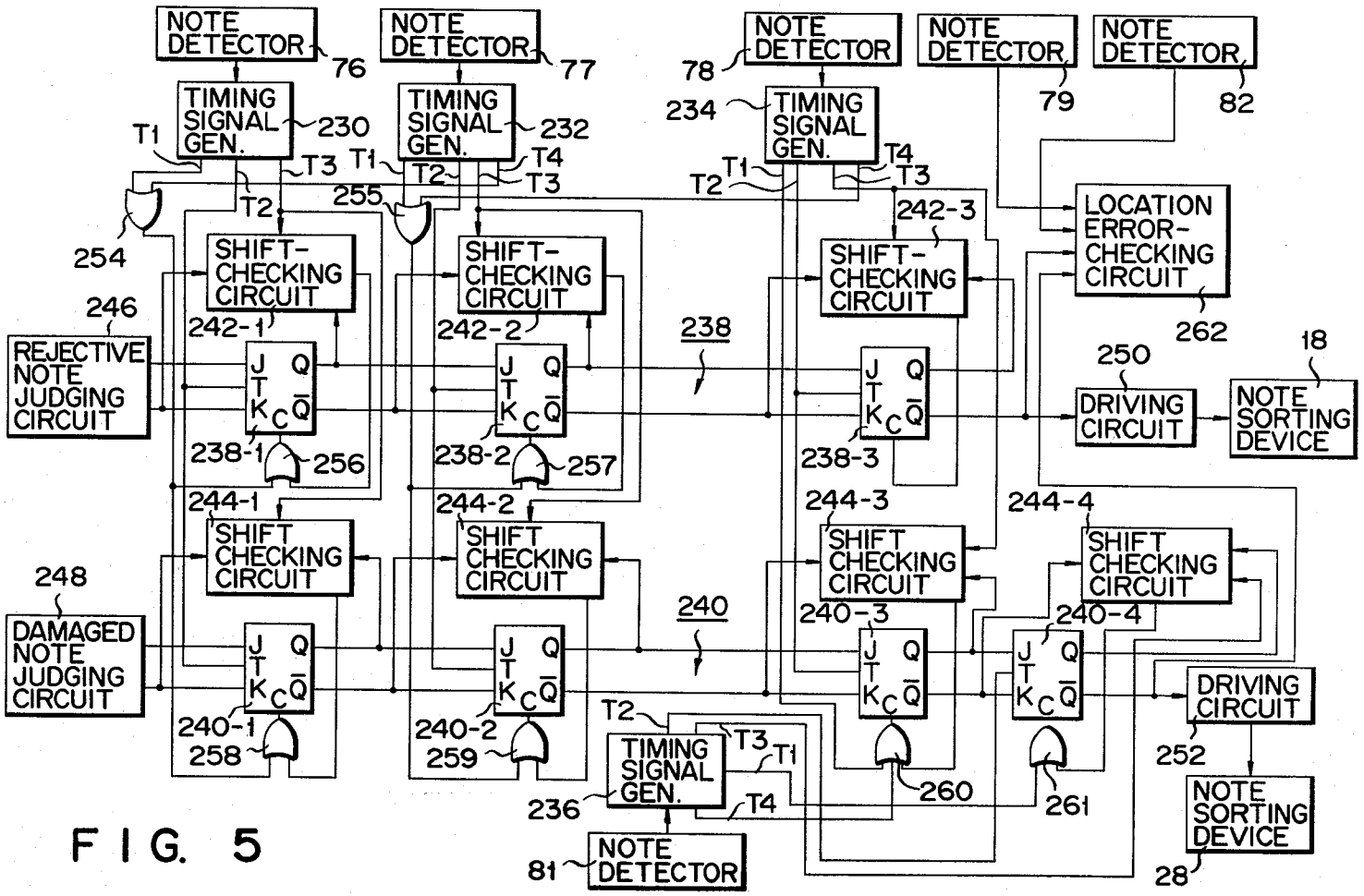
FIG. 5 is a block diagram showing the construction of a thin sheet locating circuit.

In this case, $$Q_n' = H - G_n + RA + RU - PA - PU + G_{N+1}TR$$

$$Q_{n+1}' = H - G_{n+1}TR - G_{n+1}$$

where $G_n$: the count of counter 106(108) of the nth batch $G_{n+1}TR$: the number of notes of the (n+1)th batch supplied after the abnormal conditions has been occurred and before the abnormal conditions has been cleared $G_{n+1}$: the number of notes of the (n+1)th batch supplied after the abnormal condition has been cleared The detail of the note locating circuit utilized in the apparatus of this invention will now be described with reference to FIG. 5. The note locating circuit is constructed to shift a signal produced by the aforementioned detecting device 16 and representing the result of judgement in accordance with the conveyance of corresponding notes and utilized to control the sorting devices 18 and 28 for sorting the notes into normal notes, damaged notes and improper notes. As shown, detectors 76, 77, 78 and 81 are connected to timing signal generators 230, 232, 234 and 236 respectively. The timing signals $T_1$, $T_2$, $T_3$ and $T_4$ produced by these timing signal generators are respectively supplied to J-K flip-flop circuits 238-1, 238-2, 238-4, 240-1, 240-2, 240-3 and 240-4 which constitute shift registers 238 and 240, and also to shift checking circuits 242-1, 242-2, and 242-3; and shift checking circuits 244-1, 244-2, 244-3 and 244-4. In the detecting device 16 an improper note judging circuit 246 and a damaged note judging circuit 248 are provided. The output of the improper note judging circuit 246 is connected to the input of shift register 238, that is the J and K input terminals of the first stage flip-flop circuit 238-1, whereas the output of the damaged note judging circuit 248 is coupled to the J and K input terminals of the first stage flip-flop circuit 240-1 of the shift register 240.

Where the conveyed notes are not the improper notes, the improper note judging circuit 246 sets the flip-flop circuit 238-1 to an '1' state. When the leading edge of a note reaches the detector 76 located at the exit of the detecting device 16, the timing signal generator 230 generates a timing signal $T_1$ which functions to clear the flip-flop circuit 238-1 of the shift register 238. This flip-flop circuit 238-1 is triggered by the timing signal $T_2$ to set the data produced by the rejective note judging circuit 246 in the first stage flip-flop circuit 238-1 of the shift register 238. In response to the timing signal $T_3$ the shift checking circuit 242-1 checks whether this data has been positively set in the flip-flop circuit or not. Where the result of the check shows that a different data has been set, the shift register 238-1 would be cleared. When the leading edge of the note reaches the next note detector 77, the timing signal generator 232 generates timing signals $T_1$ through $T_4$ in the same manner as above described to shift the content of the first stage flip-flop circuit 234-1 to the second stage flip-flop circuit 238-2. The timing signal $T_4$ is used to clear the first stage flip-flop circuit 238-1 after its content has been shifted to the second stage flip-flop circuit 238-2. The flip-flop circuit 238-3 is arranged to be set when the leading edge of the note reaches the note detector 78 located immediately before the next sorting device 18, and the drive circuit 250 of the sorting device 18 is controlled in accordance with the content of the flip-flop circuit 238-3. More particularly, where the output of the flip-flop circuit 238-3 is a "0", the sorting device 18 is controlled such that the notes would be conveyed to the rejective note collector 70.

On the other hand, where the notes being conveyed are not damaged notes, the damaged note judging circuit 248 sets the flip-flop circuit 240-1 to the "1" state. More particularly, by the timing signal $T_2$ which is generated by the timing signal generator 230 after the leading edge of the note has reached the note detector 76, the flip-flop circuit 240-1 would be set to the "0" state if the note is a damaged one. Thereafter the content of the shift register 240 is shifted in the same manner as above described.

When the leading edge of a note reaches a note detector 81 located immediately before the normal/damaged sorting device 28, and when data are set in the flip-flop circuit 240-4, the drive circuit 252 of the sorting device 28 would be controlled in accordance with the output of the flip-flop circuit 240-4. In other words, when the output of the flip-flop circuit 240-4 is "0", the sorting device 28 would be controlled so that the notes would be conveyed to the damaged note collector 44 (46). In FIG. 5, reference characters 254 through 261 designate OR gate circuits.

The "0" set state of shift registers 238 and 240 is determined by considering the accuracy at the time of sorting the notes. More particularly, while a signal "1" is being shifted through the shift registers, even when this signal is caused to disappear due to external noise or the like, the notes would be sorted into a collector having a higher degree of priority. For example, where a signal regarding a damaged note is caused to disappear, that note would be sorted in the improper note collector 70. A location error checking circuit 262 is connected to the outputs of shift registers 238 and 240, that is the $\overline{Q}$ outputs of the flip-flop circuits 238-3 and 240-4. For this reason, when the sorting device 18 is directed to convey the notes to the improper note collector 70 and when the notes pass through detector 79 in the normal/damaged notes conveying passageway 20, this would be judged as an location error. On the other hand, when the sorting device 28 is directed to convey the notes to the damage note collector 44 (46), a case in which the notes pass through note detector 82 in the normal note conveying passageway 24 would also be judged as a location error, and the apparatus would be locked.

Figure 6:
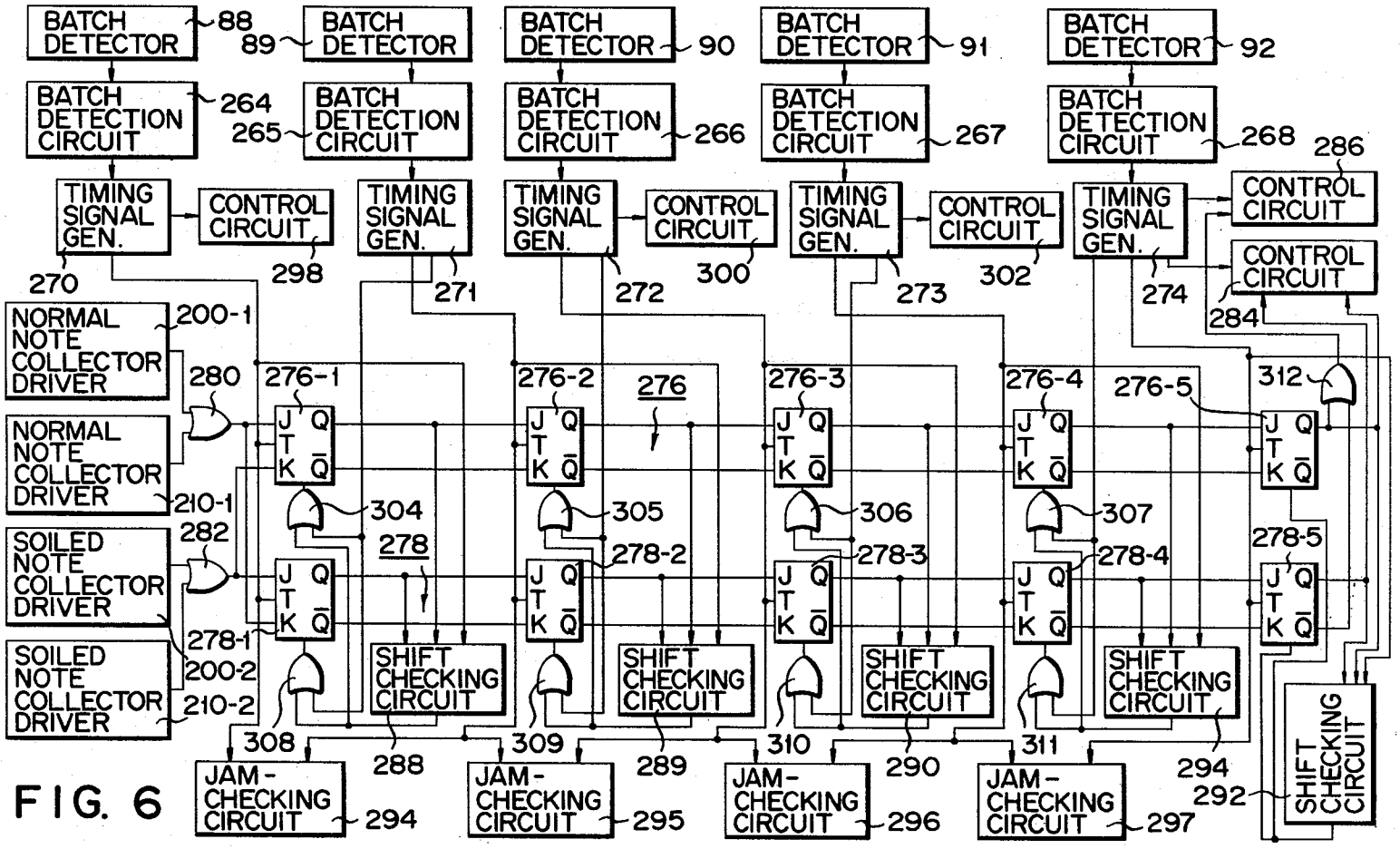
FIG. 6 is a block diagram showing the construction of a batch locating circuit.

The note batch locating circuit utilized in the apparatus of this invention will now be described, as shown in FIG. 6, the note batch locating circuit is constructed such that when the normal note collectors 34 and 36 and the damaged note collectors 44 and 46 are actuated, the circuit holds signals representing normal or damaged notes in a batch being sorted and shifts the signals while the batch is being conveyed and print a mark on the strap of that batch by the printing device 66, and that thereafter, controls a batch sorting device 68 to sort and send respective batches to respective batch collectors. Batch detectors 88 through 92 are connected to the timing signal generators 270 through 274 respectively via batch detecting circuits 264 through 268. Timing signals generated by these timing signal generators 270 through 274 are applied to trigger terminals T of flip-flop circuits 276-1 through 276-5 and 278-1 through 278-5 which constitute shift registers 276 and 278 respectively. The outputs of the first and second normal note collector drive circuits 200-1 and 210-1 (see FIG. 2C) which respectively drive the first and second normal note collectors 34 and 36 are supplied to the J input terminal of the first stage flip-flop circuit 276-1 of the shift register 276 and to the K input terminal of the first stage flip-flop circuit 278-1 of the shift register 278 via an OR gate circuit 280. The outputs of the first and second damaged note collector drive circuits 200-2 and 210-2 (see FIG. 2D) respectively driving the first and second damaged note collectors 44 and 46 are supplied to the K input terminal of the flip-flop circuit 276-1 and the J input terminal of the flip-flop circuit 278-1 respectively through an OR gate circuit 282.

When 100 normal notes are collected in the first normal note collector 34, it is driven by the first normal note collector drive circuit 200-1 to deliver a batch of 100 normal notes to the batch conveyor 50. When the batch reaches the note detector 88, the timing signal generator 270 generates a timing signal which sets a signal "1" in the flip-flop circuit 276-1 and a signal "0" in the flip-flop circuit 278-1. These "1" and "0" signals are sequentially shifted through flip-flop circuits 276-2 and 278-2; 276-3 and 278-3; 276-4 and 278-4; and 276-5 and 278-5 when normal note batches sequentially arrive at the note batch detectors 89 through 92. Finally, in response to the output of the flip-flop circuits 276-5 and 278-5, normal note signals are respectively applied to a printing control circuit 284 of the printing device 66 and a batch sorting control circuit 286 of the batch sorting device 68. As a consequence, a normal note mark is printed by the printing device 66 and then the normal note batches are sorted and collected in the normal note batch collector by the batch sorting device 68. On the other hand, when a damaged note batch is delivered from the damaged note collectors 44 and 46, a signal "0" is set in the flip-flop circuit 276-1 and a signal "1" is set in the flip-flop circuit 278-1 in a manner opposite to the case described above. Thereafter, the shifting operations are performed substantially in the same manner as above described.

For the purpose of preventing shift error, there are provided shift checking circuits 288 through 292. Where signal "1" or "0" is shifted through shift registers 276 and 278, flip-flop circuits 276-1 through 276-5, and 278-1 through 278-5 respectively constituting these registers are cleared by these shift checking circuits 288 through 292. Since a batch sorted at this time does not produce any signal, respective collector drive circuits would not be actuated so that a damaged note mark is printed on the strap of this batch and such batch is sorted and collected in the damaged note collector. As above described, even when a batch signal may be extinguished by external noise or the like, as the batch sorted at that time is judged as a damaged note batch, it is possible to improve the accuracy of sorting.

Furthermore, jam checking circuits 294 through 297 are provided between respective batch detectors 88 through 92 so as to check whether the batches are normally conveyed or not. According to this checking method, since the interval of time during which the batches are conveyed between respective batch detectors 88 through 92 is substantially constant, this interval is detected and according to the result of judgement as to whether it is shorter or longer than a preset interval, a batch jam state is determined.

When a batch passes through a batch detector 88 positioned immediately before a course changing device 52, the timing signal generator 270 produces a timing signal which is supplied to a course change control circuit 298 to control the course changing device 52. Furthermore when a batch passes through the batch detector 90 of the note batch aligning device 56, the timing signal generator 272 produces a timing signal which is applied to a rearranging device control circuit 300 thereby controlling the batch aligning device 56. Furthermore, when a batch passes through a batch detector 91 of the strapping device 60, the timing signal generator 273 generates a timing signal which is applied to a strapping device control circuit 302, thus controlling the strapping device 60. In FIG. 6, reference characters 304 through 312 respectively designate OR gate circuits.

Although it is possible to use the apparatus for processing only the note batches by supplying the batches from the note batch aligning device 56, since the batches do not produce signals, such batches are handled as damaged note batches so that damaged note marks are printed thereon and these batches are sorted and collected in a damaged note batch collector.

Figure 7:
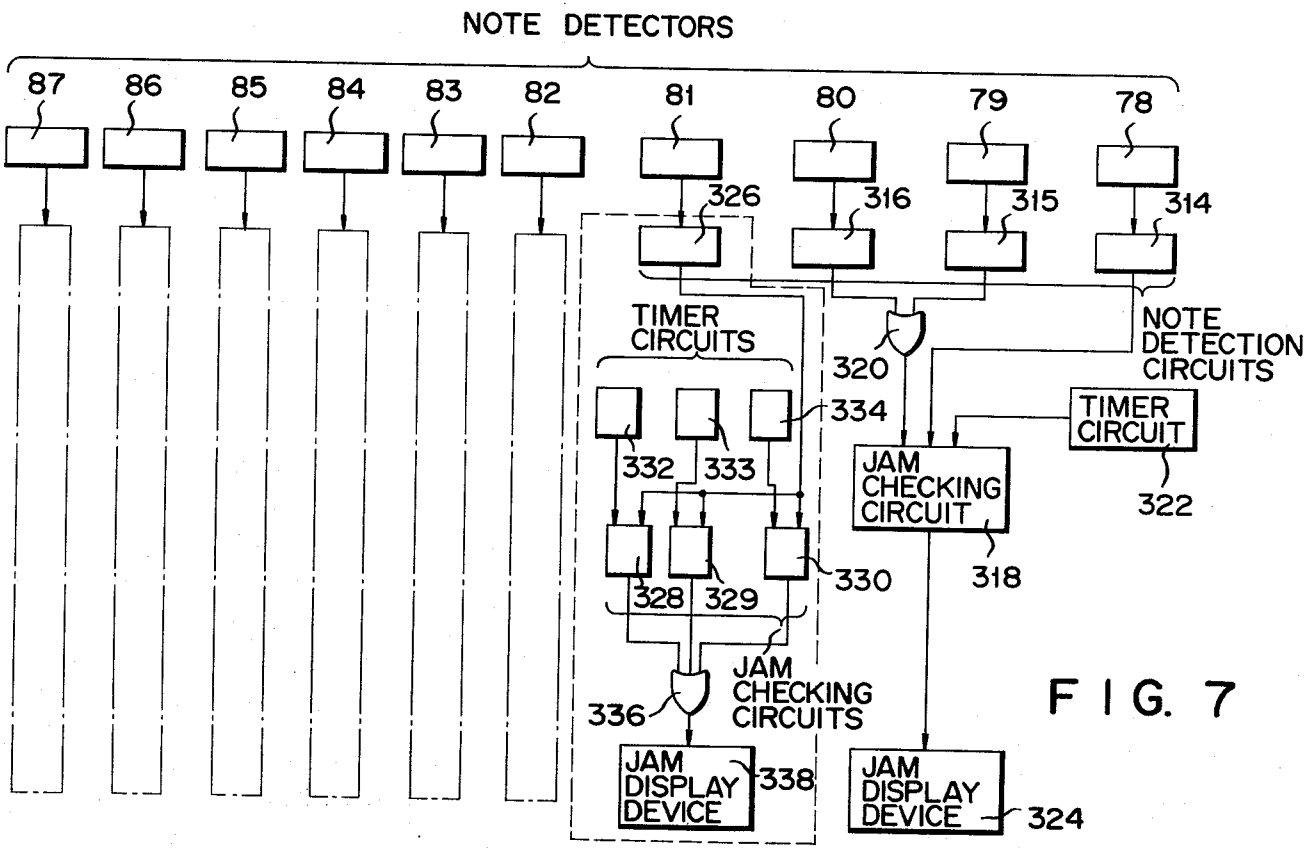
FIG. 7 is a block diagram showing the construction of a jam detection circuit.

A jam detection circuit utilized in the apparatus is shown in FIG. 7 and operates such that, for the purpose of preventing damage of the apparatus when trouble occurs while the notes are being conveyed, it immediately detects such trouble. Thus, note detection circuits 314 through 316 are respectively connected to detectors 78 through 80. The output of the note detection circuit 314 is applied directly to a jam checking circuit 318, whereas the outputs of the note detection circuits 315 and 316 are supplied to the jam checking circuit 318 through an OR gate circuit 320. The output of a time setting circuit 322 is also supplied to the jam checking circuit 318. When a note passes through the note detector 28, a time interval required for a note passed through the detector 78 to reach the note detector 79 or 80 is checked by the jam checking circuit 318. If the interval is longer than a definite interval set by the time setting circuit 322, it is judged that the note has been jammed in the sorting device 28, whereby the jam checking circuit 318 produces a signal which is displayed on a jam display device 324.

The detector 81 is connected to the note detection circuit 326, the output thereof being supplied to jam checking circuits 328 through 330, which are connected to receive also the outputs of time setting circuits 332 through 334. The outputs of the jam checking circuits 328 through 330 are supplied to a jam display device 338 through an OR gate circuit 336. The time required for a note to pass through a note detector 81 installed immediately before the sorting device 28 is checked by the jam checking circuit 328, and if the time is longer than the time preset by the time setting device 332, it is judged that the note has been jammed in the sorting device 28 or that two or more notes have been conveyed in a superpose state with the result that the jam checking circuit 328 produces a signal. The time required for a note to pass through the note detector 81 is compared with the preset time by the jam checking circuit 329 and if the former is shorter than the preset time, it is judged that the note is in a skewed state or that a substance other than the note has been conveyed, whereby the jam checking circuit 329 produces a signal. A time interval required for two consecutive notes to pass through the note detector 81 is compared with the preset time by the jam checking circuit 330, and where this interval is shorter than the preset time, the spacing between successive notes is judged too small, thus causing the jam check circuit 330 to produce a signal. In this manner, each time when one of the jam checking circuits 328, 329 and 330 produces a signal it is displayed on the jam display device 338. Circuits similar to that of the note detector 81 are also provided for another note detectors 82 through 87 for executing three types of checking described above to display the jam states.

Figure 8A:
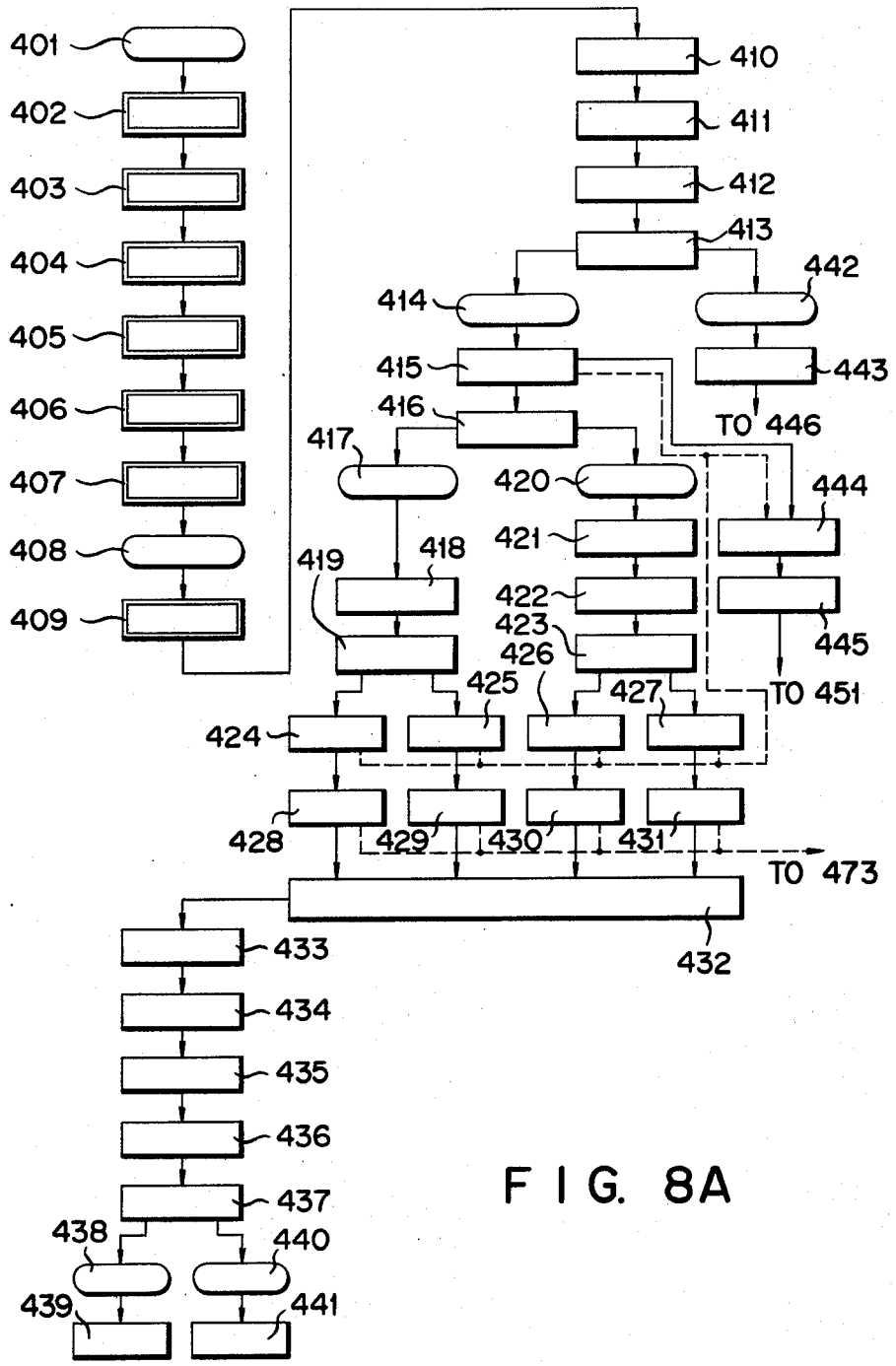
FIGS. 8A and 8B are flow charts useful to explain the operation of the apparatus of this invention.
Figure 8B:
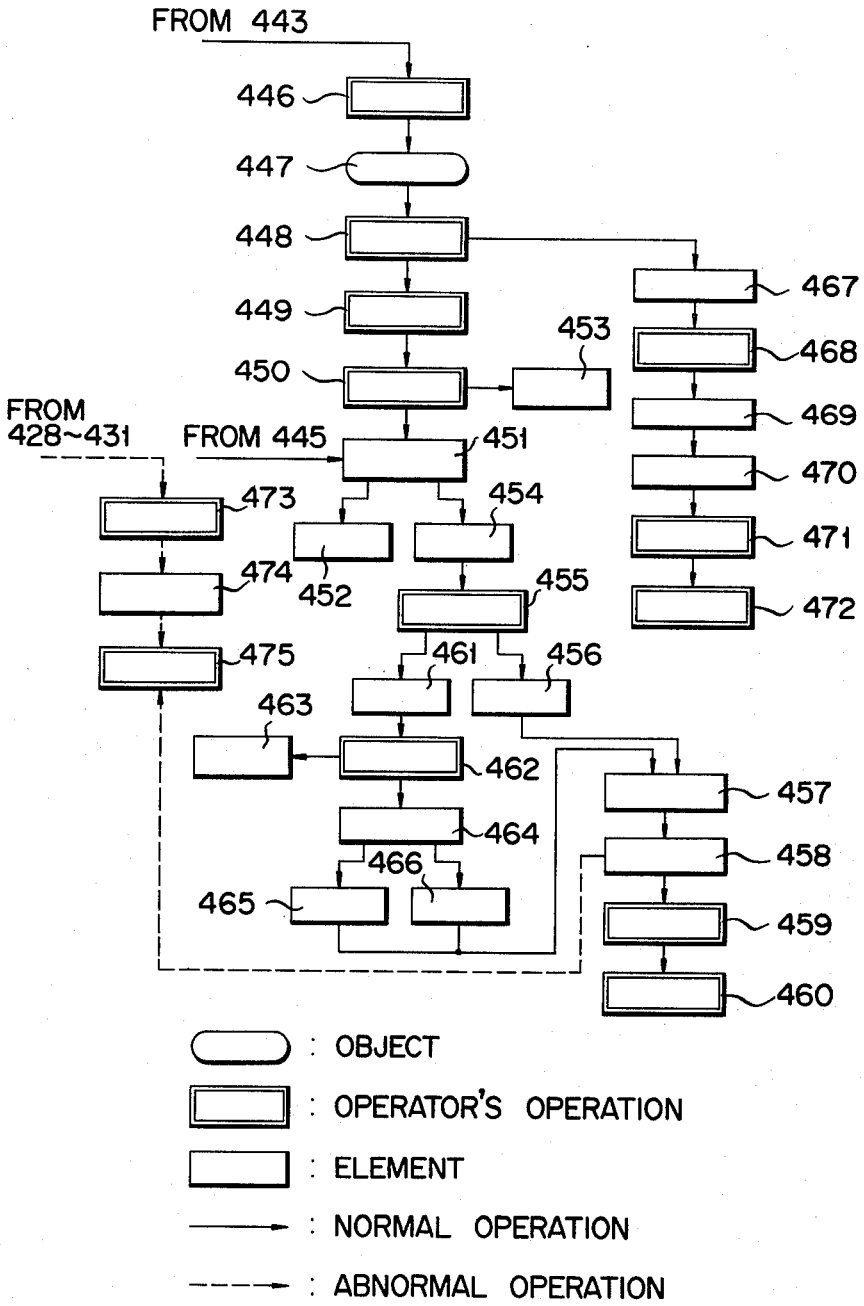

The general operation of the thin sheet sorting apparatus described hereinabove will now be described with reference to a flow chart shown in FIGS. 8A and 8B. The meaning of the steps shown in this flow chart are designated at the bottom of FIG. 8B. Again, it is assumed that 100 sheets or notes are bundled as a small bundle termed a "batch" and 10 batches are assembled into a "bundle". The sorting is executed according to the following steps. In FIGS. 8A and 8B, blocks designated by reference characters have means or execute the following procedures:

| | |
|---|---|
| 401 | Bank notes to be sorted |
| 402 | Apply a number the broad strap of the bundle |
| 403 | Remove the broad strap from the bundle |
| 404 | Put the broad strap in the receiving section |
| 405 | Apply a number the strap of the batch |
| 406 | Remove the strap from the batch |
| 407 | Put the strap in the receiving section |
| 408 | The batch of the bank notes |
| 409 | Place the batch of the bank notes in the feed section |
| 410 | Feed section |
| 411 | Pickout device |
| 412 | Detecting device |
| 413 | Sorting device |
| 414 | Normal and damaged notes |
| 415 | Counter |
| 416 | Sorting device |
| 417 | Normal note |
| 418 | Counter |
| 419 | Sorting device |
| 420 | Damaged note |
| 421 | Cancellation stamping device |
| 422 | Counter |
| 423 | Sorting device |
| 424 | Counter |
| 425 | Counter |
| 426 | Counter |
| 427 | Counter |
| 428 | First normal note collector |
| 429 | Second normal note collector |
| 430 | First damaged note collector |
| 431 | Second damaged note collector |
| 432 | Batch conveying device |
| 433 | Course changing device |
| 434 | Rearranging device |
| 435 | Strapping device |
| 436 | Stamping device |
| 437 | Batch sorting device |
| 438 | Normal note batch |
| 439 | Normal note batch collector |
| 440 | Damaged note batch |
| 441 | Damaged note batch collector |
| 442 | Improper notes (unfit notes and superposed notes) |
| 443 | Improper note collector |
| 444 | Arithmetic operation circuit |
| 445 | Memory device |
| 446 | Take out improper note |
| 447 | Improper note |
| 448 | Check the improper note |
| 449 | Count the number of the improper notes |
| 450 | Input |
| 451 | Comparator |
| 452 | Absence of exess or shortage |
| 453 | Display the input number of the improper notes |
| 454 | Presence of excess or shortage |
| 455 | Identify the input number of the improper notes |
| 456 | Absence of the input error |
| 457 | Printer |
| 458 | Print the number of batches and the number of exess or shortage notes |
| 459 | Pull out corresponding strap |

-continued

| | |
|---|---|
| 460 | Lock the apparatus and prescribed procedure |
| 461 | Presence of the input error |
| 462 | Input the correct number of the improper notes |
| 463 | Display the input number of the improper notes |
| 464 | Comparator |
| 465 | Absence of excess or shortage |
| 466 | Presence of excess or shortage |
| 467 | Unfit notes |
| 468 | Count the number of the unfit notes |
| 469 | Printer |
| 470 | Print the number of the batches and the number of the unfit notes |
| 471 | Pull out a corresponding strap |
| 472 | Lock the apparatus and prescribed procedure |
| 473 | Count the number of the bank notes in the return note box by means of a counting device |
| 474 | Count collation device |
| 475 | Manual collation |

In brief, the following procedures are performed.

(1) A bundle 401 of 1000 notes is taken out and number are applied onto their broad straps.

(2) The broad straps are removed and each bundle is divided into 10 batches. The removed broad straps are stored.

(3) One out of 10 batches is taken out and a number is applied onto its narrow strap. The narrow strap is removed and collected in a narrow strap collection box. Then a batch containing 100 notes is supplied to the feed section 410.

(4) After numbers have been applied to the narrow straps of all batches (in this example, 10 batches comprising one bundle) the narrow straps are removed from respective batches and collected in a narrow strap collection box and the notes of the batches are put into the feed section 410.

(5) The feed section 410 supplies notes of one batch to the pickout device 411.

(6) The notes are taken out, one after one, by the pickout device 411.

(7) Detector 412 judges each taken out note as to whether it is a superposed note, counterfeit, a note of different type, an unusable note, a normal note or a damaged note.

(8) The results of judgement of the notes are classified into three types of the judgement result signals.

(9) These judgement result signals are shifted in the note locating circuit while the notes are being conveyed and the courses of the sorting devices 413 and 416 are determined by these signals to guide the notes along the courses thus determined.

(10) The sorting device 413 guides improper notes 442 (notes other than the normal notes and damaged notes) to the improper note collector 443.

(11) The normal and damaged notes 414 passed through the sorting device 413 reach the sorting device 416 and sorted into the normal notes 417 and the damaged notes 420.

(12) The numbers of the normal and damaged notes 414 passing through the sorting device 416 are counted by the counter 415.

(13) The number of the notes 417 sorted as the normal notes by the sorting device 416 is counted by the counter 418 installed before the sorting device 419 and each time when 100 notes and counted the courses are switched between the normal note collector 428 and 429 by the sorting device 416.

(14) At this time, the number of the notes guided to the normal note collectors 428 and 429 are counted by counters 424 and 425 respectively.

(15) The notes 420 sorted as the damaged notes by the sorting device 416 are printed with damaged marks by the cancellation stamp device 421 for preventing them from recirculation, and each time when 100 sheets of such notes are counted by the counter 422 installed before the sorting device 423 the course of the sorting device 423 is switched between the damaged note collectors 430 and 431.

(16) When no location error or count error is confirmed at the time of completing the feed of the notes of one batch, the count of the counter 415 is supplied to the arithmetic operation circuit 444 and the difference between the count and the preset value is stored in the memory device 445 together with the batch number.

(17) When 100 sheets of the normal notes or damaged notes are collected in respective collectors and when the collector to which the notes are guided is switched, a collector which has collected 100 notes is driven to delives a batch of 100 notes to the batch conveyer 432 and the batch is conveyed to the course changing device 433.

(18) The batch arrives at the course changing device 433 is rotated 90° and then conveyed toward the note batch aligning device 434.

(19) The batch reached the note batch aligning device 434 is aligned into a cube and then conveyed to the strapping device 435.

(20) The batch arrived at the strapping device 435 is applied with a strap and then printed with necessary items by the printing device 436, and a mark representing the normal or damaged note is also printed on the strap in accordance with a shift signal from the batch locating circuit.

(21) The batches printed with marks by the printing device 436 are classified by the sorting device 437 into a normal note batch 438 and a damaged note batch 440 which are guided to corresponding batch collectors 439 and 441 respectively.

(22) The improper notes 442 collected in the improper note collector 443 at step (10) are taken out from the collector 443 by the operator and the number of them is counted. Also the operator counts the number of the unfit notes (counterfeit notes, different type notes and not effective notes).

(23) The operator sends the number of unfit notes corresponding to the difference between the number of the improper notes 442 and the number of the superposed notes to the memory device 445 by using the keyboard.

(24) Where the number of the improper notes and the number of the unfit notes are both zero, the comparator 451 compares the difference between the set value read out from the memory device 445 and the count of the counter 415 with the value applied by the keyboard to judge whether the number of notes fed to the apparatus is excessive or short.

(25) Where the result of comparison shows that there is no excess or shortage in the notes supplied, the improper notes and unfit notes of the next batch are taken out from the improper note collector 443 and the procedures of steps (22), (23) and (24) are repeated.

(26) Where the result of comparison shows that the number of the notes supplied is excessive or short, since the applied data is being displayed by the display device 453, the operator can confirm the input error by viewing the displayed data. Where an input error is noted, the operator inputs again the correct number of the notes with the ten key. Where the excess or shortage of the number of the notes is corrected by this: reinput the printer 457 prints the number of the batch, the number of the input errors, and the data applied again with the result that the key input device which has been locked will be automatically unlocked, and the procedures of steps (22), (23) and (24) are repeated for the next batch.

(27) Where the number of the note supplied is excessive or short but no input error was made and where such excess or shortage is not corrected by the reinput, the key input device would be locked. Release of such locked condition is possible only by a key in the hand of a supervisor. When the key input device is locked, the supervisor takes out the narrow strap of a batch whose number is displayed in a display device from the strap collecting box and knows the batch number printed by the printer 457 at the time of unlocking and the total number of the notes of the batch.

(28) Where the keyboard inputs the number of the unfit notes (counterfeit notes, different type notes and not effective notes) by data other than "0", the key input device would be locked just in the same manner as in the case where the number of the notes is excessive or short. In this case, the operator deliver the unfit notes and the narrow strap of a bundle contained such batch to the supervisor and asks him to release the locked condition. When unlocked, the number of the unfit notes and the batch number thereof are printed by the printer 457.

(29) The numbers of the improper notes and the unfit notes inputed by the ten key is supplied to the memory device 445. Before the numbers of the improper notes and the unfit notes of the next batch are applied, the numbers of the improper notes and the unfit note are respectively added to the total number of the improper note and to the total number of the unfit notes which has been collected in the improper note collector 443 until the next batch was processed, and these sums are stored in the memory device 445.

(30) When a jam occurs in a sorting device or a collector, or a location error occurs in the sorting device 413, they are detected by the jam detection circuit and the conveyance of the notes is stopped. In this case, since a position at which such trouble has occurred is displayed, it is possible to remove or correct a note at that position and then all notes in the conveying passageway are collected in a collector by the operator. At this time, the pickup device 411 is inoperative.

(31) Also where there is a sorting error (where it is doubtful that whether the number of the collected notes is exactly 100 or not) or a collation error (collation of the counts is not reasonable) or a location error (where damaged notes are erroneously sorted as normal notes) the pickup of the notes is interrupted and all the notes in the conveying passageway are collected in a collector.

(32) Subsequent to steps (30) and (31) all notes in all collectors are transferred into the return note box by the operator.

(33) Thereafter feeding of the notes is resumed and when the sorting of one batch is completed, the number of notes after step (32) is counted by counter 415 and the arithmetic operation step (16) is executed. The result of this operation is stored in the memory device 445 together with an abnormal code.

(34) For the purpose of judging the excess or shortage of the number of the notes in a batch described in step (33), the procedures of steps (22), (23) and (24) are repeated in the same manner as the cases of jam, 100 sheets sorting error, collation error and locating error. In this case, however, as the number of the notes supplied subsequent in the procedure of step (32) is compared with the number of notes inputted by the ten key, the number of the notes always becomes short so that the apparatus is locked. Accordingly, the number of the notes in the return note box is counted by a conventional counter 474 and the resulting count is inputed by the ten key. If there is no excess or shortage, the key input device would be unlocked. At this time, the number of the notes in the return box is printed.

(35) Where the number of the note is not excessive or short the step (25) is repeated, whereas where the number is excessive or short, the procedures of steps (26) through (29) are repeated.

(36) Wide and narrow straps of bundles and batches which have been confirmed by collation that their number of notes is correct and that they do not contain any unfit note (counterfeit, different type note and not effective note) are discarded.

(37) After finishing the collation by using the sorting device and the key input device, the printer prints the total number of the notes in the improper note collector 443 and the total number of the unfit notes so that the operator can confirm again the numbers of the notes at his hand.

According to the embodiment described above, it is possible to accurately judge that whether the number of notes in a unit of 100 is excessive or short, and that whether normal notes, damaged notes and improper notes are present or not. Accordingly, it is possible to judge that which one of the batches of 100 notes among a bundle of 1000 notes contained abnormal notes. Even when unfit notes are found, it is possible to collate the counts without locking the apparatus and then refeeding the notes. Thus it is easy to know that a batch handled by a specific person contained abnormal notes. Furthermore, as the number of the normal notes and the damaged notes in each batch of 100 notes is memorized it is not necessary to collate the counts by stopping the sorting operation at each unit of 100 notes but instead the sorting may be performed continuously and the collation of the counts may be done afterward. In addition, it is not necessary to insert sorting cards at every 100 notes as in the prior art. Furthermore, since the collation of the notes supplied is performed without the necessity of feeding again superposed notes, even when units of 100 notes are processed there is no fear of lowering the processing capability and increasing the burden of the operator.

Figure 9:
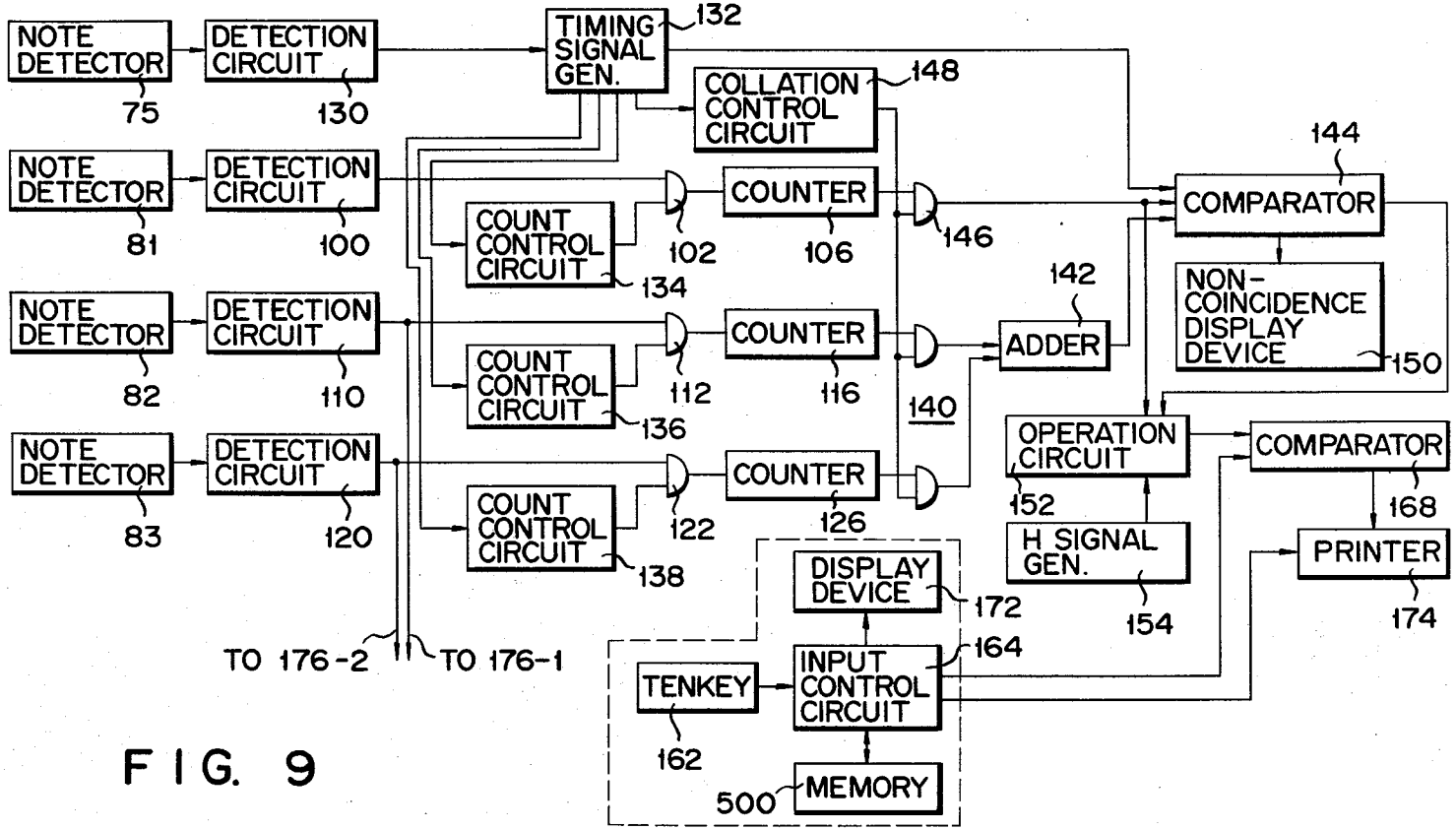
FIG. 9 is a block diagram showing counters utilized in another embodiment of this invention.

A second embodiment of the thin sheet sorting apparatus of this invention will now be described with reference to FIG. 9 showing a portion of a counting circuit corresponding to FIGS. 2A and 2B, wherein circuit elements corresponding to those shown in the first embodiment are designated by the same reference charactors. This modification is different from the first embodiment in only a counting circuit which compares the difference between the counts of the number of notes collected in the normal note collector and the damaged note collector and the preset value with the number of rejective notes inputted by the ten key to judge the excess or shortage in the number of the notes supplied. The remaining portions of the counting circuit for counting the number of notes sorted and collected in respective collectors are the same as those shown in FIGS. 2C and 2D. More particularly, in this modification only one set of counters is provided for counting the number of signals from a detector 81 in the first passageway for conveying the normal and damaged notes, a detector 82 in the passageway for conveying the normal notes, and a detector 83 in the passageway for conveying the damaged notes so as to simplify the construction. Accordingly, where the result of collation of the counts before and after the normal/damaged sorting device 28 shows that there is no count error, the arithmetic operation circuit 152 calculates the difference between the count (number of the normal and damaged notes) of the counter 106 and the preset value H to supply the result to a comparator 168. The number of the improper notes is supplied to the comparator 168 from a ten key 162 via an input control circuit 164 to be compared with the output of the arithmetic operation circuit 152. Only when a coincidence is obtained showing that the number of the sheet supplied was correct, pickout onto the note of the next batch is performed by the pickout device 12.

Thus, in this modification feed operation is stopped at each batch.

On the other hand, where the result of comparison of the comparator 168 shows that the number of notes fed is excessive or short, it is displayed on a display device, not shown, and the apparatus is locked for preventing further operation. At this time, the data (the number of the improper notes) supplied by the keyboard 162 is displayed by a display device 172. Where, there is an input error, similar processing to that of the first embodiment is executed. The data inputted by the keyboard 162 is also supplied to an addition memory device 500 and added to the data inputted by the keyboard previously and the sum is stored in the addition memory device 500. For this reason, after completing the sorting operation of one bundle in a definite time, for example in one hour, when the note collected in the improper note collector 70 is processed by depressing a reprocessing button, not shown, the content of the addition memory device 500 is supplied to the comparator 168 to be compared or collated with the difference between the count of the counter 106 and the set value thus enabling to check again the key input error.

As above described, in this second embodiment the counters necessary for counting the number of the normal and damaged notes is only one set, and the apparatus is stopped temporarily at each sorting operation of one batch to perform collation of the counts. Thus, as the number of the sorted notes is not memorized it is necessary to collate the counts after each sorting operation and it is impossible to collate the counts of the preceding batch during the sorting operation. Accordingly, during the sorting operation the operator can not perform any operation. However, it is possible to simplify the construction than the first embodiment.

Although in the above, classification of bank notes was described it should be understood that the invention is not limited to such specific use but may be used to classify any other type of thin sheets as slips.

What we claim is:

1. A thin sheet sorting apparatus comprising:

means for holding a predetermined number of thin sheets;

pickout means for picking out thin sheets one by one out of said holding means;

judging and classifying means for judging the kinds of thin sheets taken out by said pickout means and classifying the thin sheets into first thin sheets including those thin sheets not capable of judgement and the remaining second thin sheets;

first and second collector means connected to said judging and classifying means for collecting the first and second thin sheets respectively;

means connected to said second collector means for counting the number of thin sheets collected;

inputting means for setting the number of thin sheets collected by said first collector means and counted by an operator; and detecting means connected to said counting means and said inputting means for producing a detection signal indicating, based on the number of thin sheets counted by said counting means and the values set by said inputting means, that the number of thin sheets in said holding means is not said predetermined number.

2. A thin sheet sorting apparatus according to claim 1, wherein said detecting means compares the set value of said inputting means with a value obtained by subtracting the number of thin sheets counted by said counting means from said predetermined number of thin sheets to be held by said holding means and produces the detection signal when no coincidence occurs between both the values.

3. A thin sheet sorting apparatus according to claim 1 or 2, further comprising means for displaying the number of sheets set by said inputting means, whereby an operator can notice that a wrong number of thin sheets is set.

4. A thin sheet sorting apparatus comprising:

means for separately holding thin sheet units each having a predetermined number of thin sheets;

pickout means for picking the thin sheets, one by one, out of said holding means from each of the respective units between which a predetermined operation rest period is provided;

judging and classifying means for judging the kinds of thin sheets taken out by said pickout means and for classifying the thin sheets into first thin sheets including those thin sheets not capable of judgement and the remaining second thin sheets;

first and second collector means connected to said judging and classifying means for collecting the first and second thin sheets respectively;

means connected to said second collector means for counting the number of thin sheets collected for each unit;

inputting means for setting the number of thin sheets collected by the first collector means for each unit and counted by an operator;

means connected to said counting means for subtracting the number of thin sheets, in each unit, counted by said counting means from said predetermined number of thin sheets to be included in the unit and for storing the number of the unit and the result of subtraction in a parallel relation; and detecting means connected to said inputting means and said storing means for comparing for each unit the result of subtraction stored in said storing means and the set value of said inputting means and for producing, when no coincidence occurs between both the values, a detection signal indicating that the number of thin sheets of the unit included in said holding means is not said predetermined number.

5. A thin sheet sorting apparatus according to claim 4 in which said storing means further stores a sum of values set by said inputting means with respect to all the units; and after the thin sheets in all the units are classified and collected in said first and second collector means, the number of thin sheets collected in said first collector means can be reconfirmed by causing those thin sheets collected in said first collector means to be again set by said holding means and again processed.

6. A thin sheet sorting apparatus according to claim 1, 2 or 4, in which said judging and classifying means judges a normal sheet, damaged sheet, unfit sheet and superposed sheet and classifies the former two sheets and latter two sheets into first and second sheets, respectively.

7. A thin sheet sorting apparatus according to claim 6, in which the unfit sheet and superposed sheets are separately set by said inputting means, and said sorting apparatus stops its operation when the number of unfit sheets is set to be other than zero.

8. A thin sheet sorting apparatus according to claim 1, 2, or 4 which stops its operation by the detection signal.

* * * * *